US010696473B2

(12) United States Patent
Hess et al.

(10) Patent No.: US 10,696,473 B2
(45) Date of Patent: Jun. 30, 2020

(54) MATERIAL TRANSPORT SYSTEM AND METHOD

(71) Applicant: North Cliff Corporation, Berlin, WI (US)

(72) Inventors: Michael C. Hess, Berlin, WI (US); Preston M. Hess, Berlin, WI (US); Dan Koxlien, Whitehall, WI (US)

(73) Assignee: Can Do Logistics LLC, Berlin, WI (US)

( * ) Notice: Subject to any disclaimer, the term of this patent is extended or adjusted under 35 U.S.C. 154(b) by 72 days.

(21) Appl. No.: 15/722,528

(22) Filed: Oct. 2, 2017

(65) Prior Publication Data

US 2018/0093823 A1 Apr. 5, 2018

Related U.S. Application Data

(60) Provisional application No. 62/545,664, filed on Aug. 15, 2017, provisional application No. 62/403,369, filed on Oct. 3, 2016.

(51) Int. Cl.

| | |
|---|---|
| ***B65D 88/30*** | (2006.01) |
| ***B65D 90/58*** | (2006.01) |
| *B65D 6/16* | (2006.01) |
| *B65D 6/38* | (2006.01) |
| *B65D 6/34* | (2006.01) |
| *B65D 88/52* | (2006.01) |
| *E21B 43/267* | (2006.01) |

(52) U.S. Cl.

CPC ..... *B65D 88/30* (2013.01); *B65D 90/587* (2013.01); *B65D 7/24* (2013.01); *B65D 7/46* (2013.01); *B65D 11/28* (2013.01); *B65D 88/528* (2013.01); *E21B 43/267* (2013.01)

(58) Field of Classification Search

CPC ..... B65D 88/30; B65D 88/26; B65D 7/46; B65D 7/24; B65D 88/526; B65D 88/528

See application file for complete search history.

(56) References Cited

U.S. PATENT DOCUMENTS 3,602,400 A * 8/1971 Cooke ..... B65D 88/128 222/143
5,762,222 A * 6/1998 Liu ..... B65D 19/12 206/512
8,585,341 B1 11/2013 Oren et al.
(Continued)

FOREIGN PATENT DOCUMENTS

WO 20150192061 12/2015

OTHER PUBLICATIONS

International Search Report and Written Opinion for PCT/US2017/054748 dated Feb. 9, 2018.

*Primary Examiner* — J C Jacyna
(74) *Attorney, Agent, or Firm* — Christopher M. Scherer; DeWitt LLP

(57) ABSTRACT

A material transport system and method having a frame with a plurality of upright frame members, upper lateral frame members, central lateral frame members, and lower lateral frame members. In one aspect, removable sidewalls can be affixed to the frame. In other aspects, the removable sidewalls have a density that is less than the density of the frame members. In other aspects, a modular container can be disposed in the frame. The frame can be constructed from a material having a lower density than the materials used for the frame.

23 Claims, 18 Drawing Sheets

(56) References Cited

U.S. PATENT DOCUMENTS

| | | | | |
|---|---|---|---|---|
| 2009/0057272 | A1* | 3/2009 | Modgil | B65D 7/24 217/17 |
| 2011/0127178 | A1* | 6/2011 | Claussen | B65D 88/26 206/216 |
| 2012/0181086 | A1* | 7/2012 | Addison | B65D 88/26 175/66 |
| 2015/0086307 | A1 | 3/2015 | Stefan | |
| 2015/0291348 | A1 | 10/2015 | Lopez | |

* cited by examiner

MATERIAL TRANSPORT SYSTEM AND METHOD

CROSS-REFERENCES TO RELATED APPLICATIONS

This application claims the benefit of prior-filed, co-pending U.S. Provisional Patent Application No. 62/403,369, filed Oct. 3, 2016, and U.S. Provisional Patent Application No. 62/545,664, filed Aug. 15, 2017, the entire contents of which are incorporated herein by reference.

FIELD OF THE INVENTION

The present application is directed to the field of material distribution. More specifically, the present application is directed to the field of loading, distributing, unloading and storing large amounts of material such as proppant to frac well sites.

BACKGROUND

Proppants are silica sand and ceramic beads that are used to stimulate oil and gas wells. The process of utilizing proppants in wells is done to increase the well performance. The industry typically uses over 50 million tons of proppant annually. The products are typically processed and/or manufactured at a large production facility. The finished products are typically shipped by rail to transload sites where the proppants are stored and loaded to truck for transportation to the well site.

A typical transload is a site with rail track and storage silos used to off load proppant materials from the railcar. Proppants are transported in rail hopper cars from the production facilities to these transload sites and either off loaded to tanks or stored in the hopper car itself until sold. A common problem with storing proppant in hopper cars is that the car utilization for transport is lost, and depending on location, rail demurrage charges can accumulate. Demurrage can accumulate to millions of dollars annually.

Another problem that has developed in the industry is congestion at the transload sites which sometimes causes an embargo by the servicing railroads. Also, proppant storage is limited to areas with the typical needed infrastructure.

Further, the industry transloading process can be problematic in that infrastructures are typically large and permanent. Currently, hopper railroad cars are pulled into the processing plant and loaded through the top. The railcars then go to a transload site. The transload sites have yards with rail track and large storage tanks, and the railcars are emptied into the tanks. The empty railcars are pulled out and sent back to the plant. Typically, there's not enough tank storage at the transload site to hold all of the proppant, such as sand, so it is typically stored in the railcar. Some of the railcars may sit on the track for significant lengths of time, incurring significant costs for the supplier.

Further, hydraulic fracturing, or "frac" wells are becoming much larger and have more volume per well when compared with prior wells, necessitating railcars for storage. This fills up all the railroad track, resulting in railroad embargos on track, thus resulting in lost sales.

In another aspect, most conventional container systems used in the oil and gas industry are in the 12 to 23 ton range. This is generally the maximum capacity of a conventional steel transport system because the total weight of the system and material has to stay within legal road haul limits.

SUMMARY

In one aspect, the material transport system of the present application is designed to transport and store proppants for the oil and gas industry. In another aspect, the bolt together design and modular container designs described herein typically permits the use of lighter weight materials for the system. Each pound that is removed from the weight of a transport system container allows for an additional pound of material to be placed in the container and transported, thereby reducing transportation expense on a per ton basis. In another aspect, the construction of the present application can reduce the expense associated with repair and maintenance on the transport system as well as the downtime of a transport system while the system is being repaired.

In another aspect, a material transport system according to the present application can include a removable material container positioned within a frame. In one aspect, the material container can be formed of a composite material. The use of such composite materials can reduce the overall weight of the material transport system according to this application. In other aspects, the container can include flanges that can be used to secure the container to the system frame. In other aspects, lower portions of the container can be supported by the system frame.

Following are additional aspects of the transport system of the present application:

Typical capacity of approximately 25 tons per transport system while maintaining the existing footprint;

In other aspects, typical capacity of approximately 24 to 28 tons per transport system;

Approximate typical tare weight of 3800 pounds with potential to go lighter depending upon the materials used;

In other aspects, approximate typical tare weight of 3200 pounds with potential to go lighter depending upon the materials used;

Typical structural framework can be reduced in size and optional hopper materials will be bolted together rather than welded;

Typical elimination of need for tools, pneumatics, hydraulics or other special resources typically needed to open and close the hopper gate;

Inclusion of a top hatch that can typically allow for optional flow through applications between stackable transport systems; and Inclusion of a bolt on hopper section that can typically permit flexibility of materials used for hopper section.

In other aspects, inclusion of a molded composite container or hopper section that can typically permit flexibility of materials used for the container or hopper section.

The advantage is that the systems may be shipped on a flat car and unloaded and stored off the track on a piece of property. That flat car may then go right back to the plant, eliminating that slack time, and storage time.

As a further advantage, the same amount of volume may be moved, and demurrage charges and railcar and rail charge will be minimized or eliminated.

Further, this transport system may increase the volume of your shipping, as embargo situations will not occur.

DETAILED DESCRIPTION OF THE DRAWINGS

Figure 1:
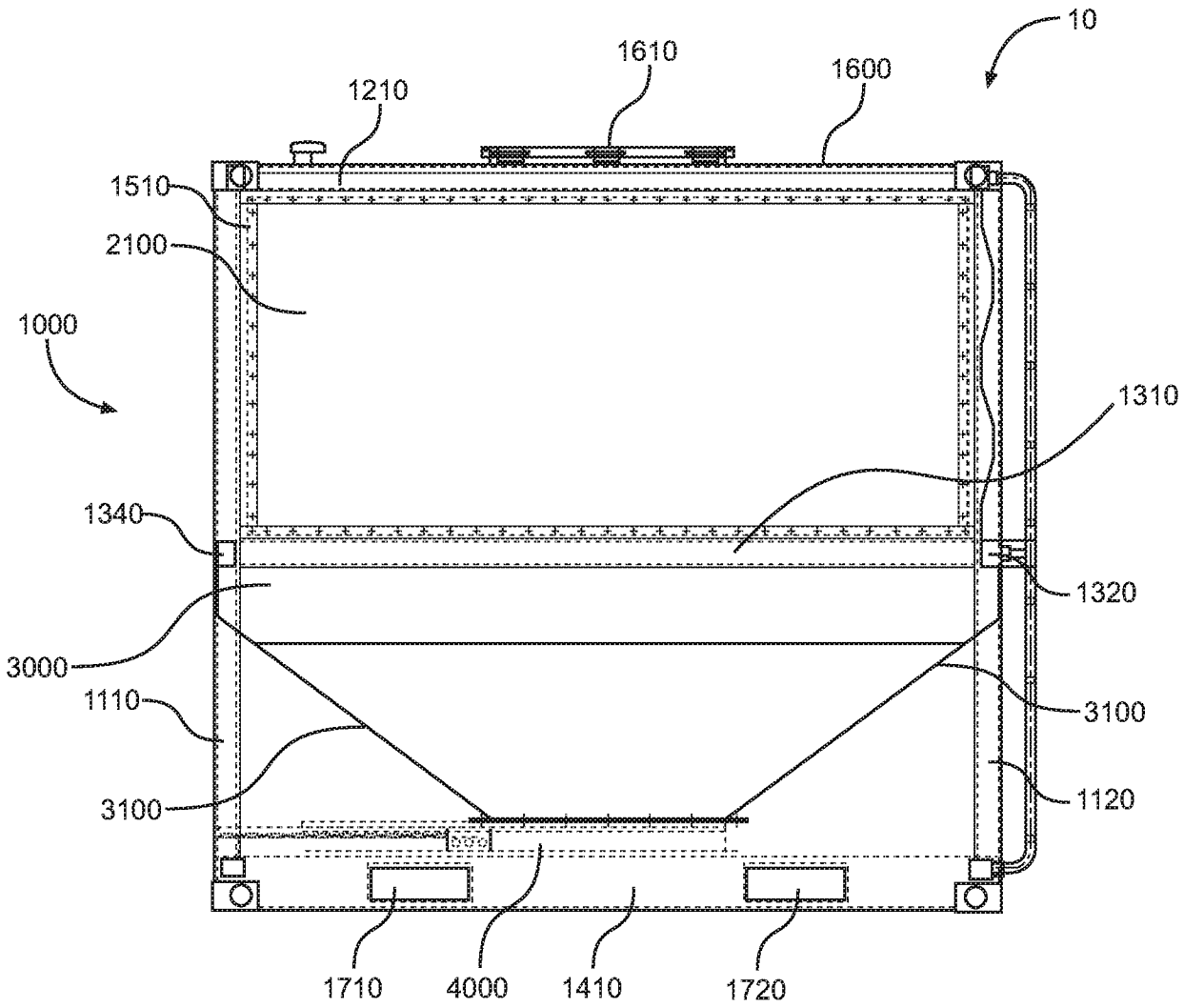
FIG. 1 is a front view of a transport system according to an aspect of this application.

In the present description, certain terms have been used for brevity, clearness and understanding. No unnecessary limitations are to be applied therefrom beyond the requirement of the prior art because such terms are used for descriptive purposes only and are intended to be broadly construed. The different systems and methods described herein may be used alone or in combination with other systems and methods. Dimensions and materials identified in the drawings and applications are by way of example only and are not intended to limit the scope of the claimed invention. Any other dimensions and materials not consistent with the purpose of the present application can also be used. Various equivalents, alternatives and modifications are possible within the scope of the appended claims. Each limitation in the appended claims is intended to invoke interpretation under 35 U.S.C. § 112, sixth paragraph, only if the terms "means for" or "step for" are explicitly recited in the respective limitation.

Figure 11:
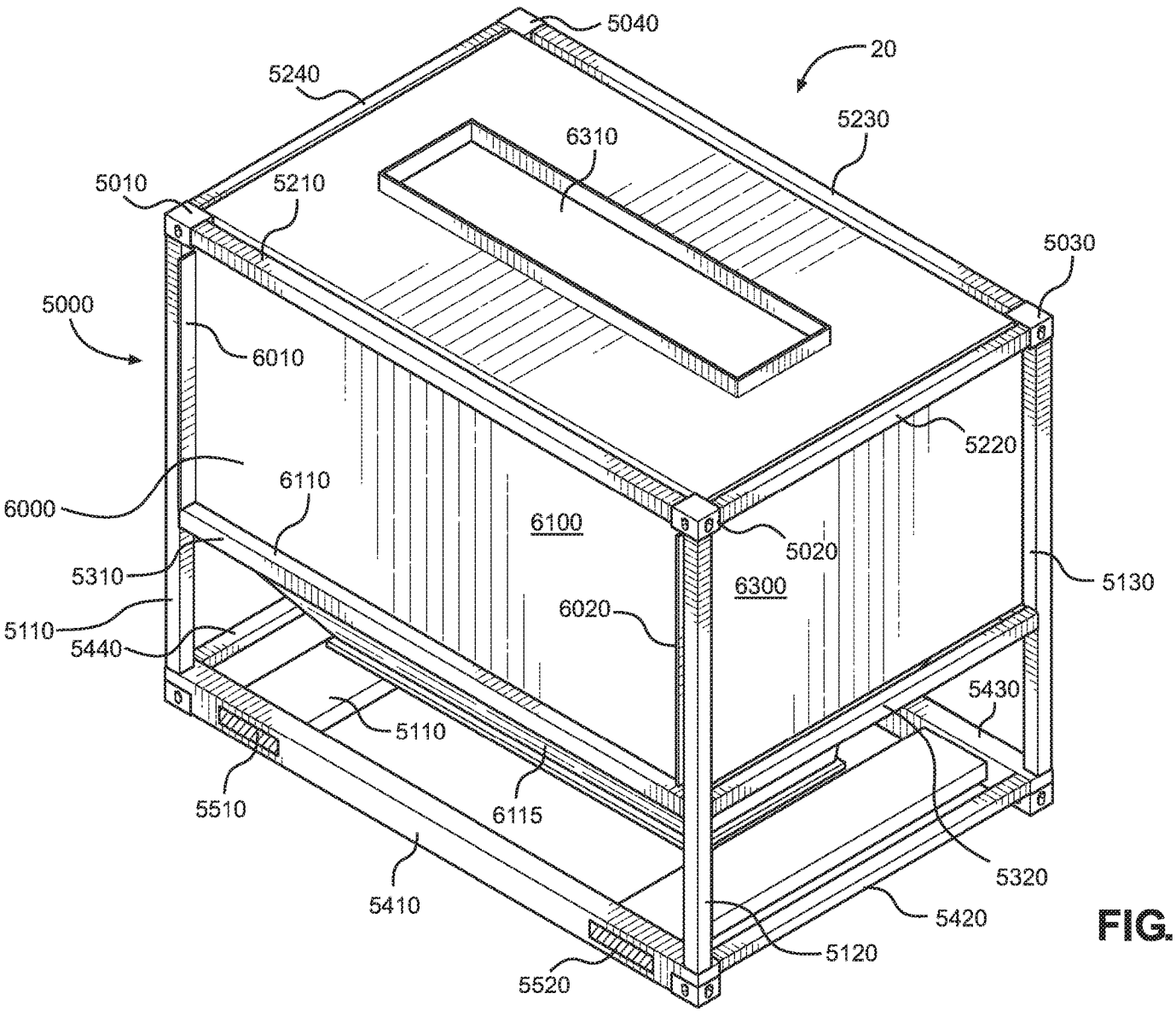
FIG. 11 is a perspective view of another transport system according to another aspect of this application.

Referring to FIGS. 1 and 11, material transport systems 10 and 20 according to various aspects of the application are shown. In one aspect, the systems 10 and 20 of the present application are designed to transport and store proppants for the oil and gas industry. Systems 10 and 20 can also be used to transport other materials, including granular materials. Systems 10 and 20 may be transported by truck or flat railcar and may also be stored at a typical transload site or transported by truck and stored at a much more remote site closer to the well location. Systems 10 and 20 can typically be off loaded much quicker than unloading the bulk hopper cars. This can reduce rail time and demurrage fees as well as improving on car utilization. It can also reduce railcar congestion at the transload sites. In another aspect, systems 10 and 20 are typically constructed to have a footprint of 8 feet by 10 feet, which is typically in compliance with an ISO standard, along with a typical capacity of 36,000 pounds (i.e., 25 ton). Systems 10 and 20 can likewise be constructed to have other suitable footprints and capacities, including without limitation a footprint of 8 feet by 12 feet, capacity of 50,000 pounds, as well as any other footprint and capacity not inconsistent with the present application.

Removable Sidewall Material Transport System Configuration

Figure 2:
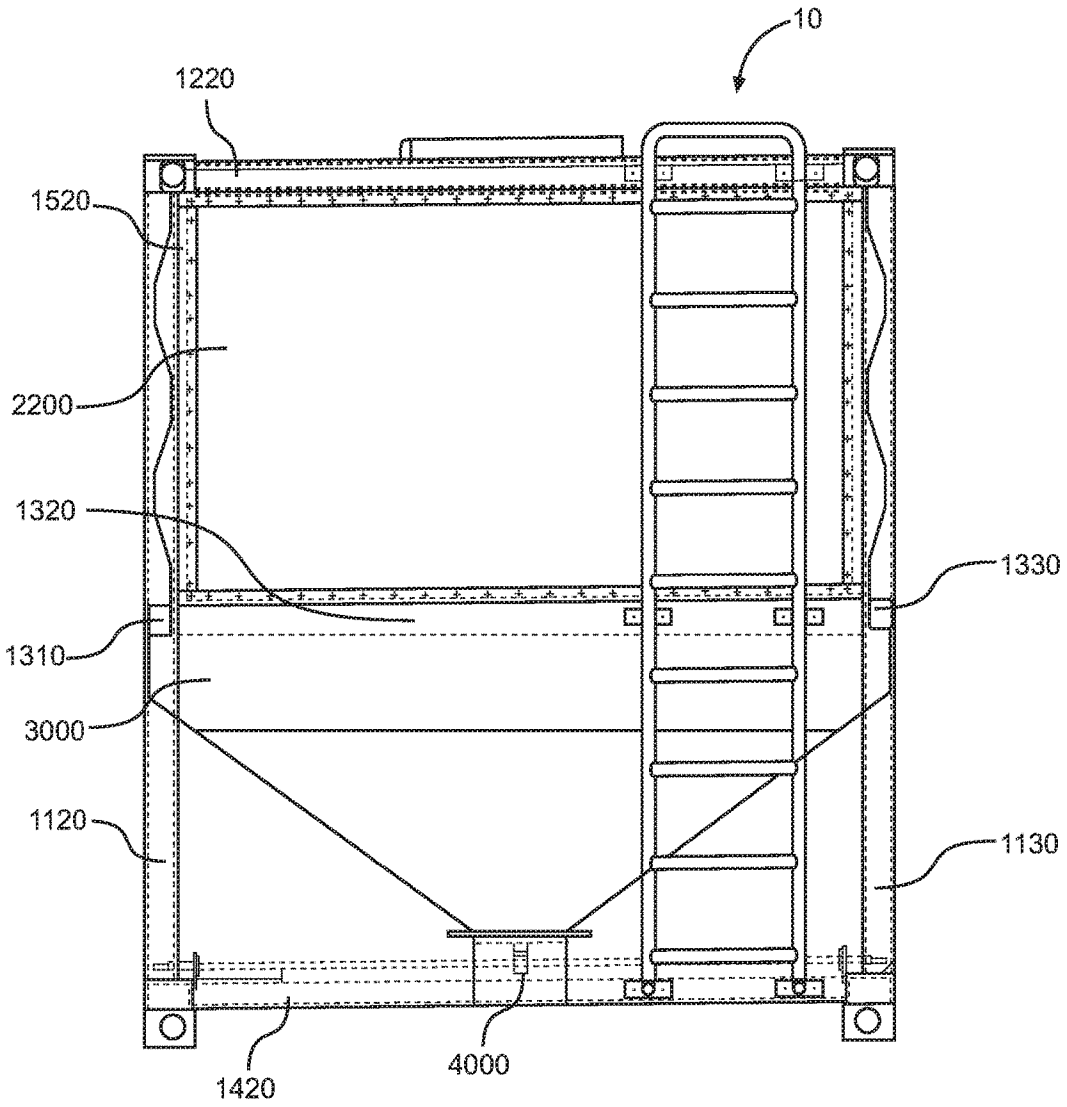
FIG. 2 is a side view of a transport system according to another aspect of this application.

Referring to FIGS. 1 and 2, system 10 according to one aspect of the application typically includes a frame 1000 having a plurality of upright frame members 1110, 1120, 1130, and 1140. Frame 1000 also typically includes a plurality of upper lateral members 1210, 1220, 1230, 1240, a plurality of central lateral members 1310, 1320, 1330, and 1340, and a plurality of lower lateral members 1410, 1420, 1430, and 1440. Upper lateral members 1210, 1220, 1230, and 1240 are typically welded or otherwise mechanically interconnected proximate the upper end of upright frame members 1110, 1120, 1130, and 1140. Central lateral members 1310, 1320, 1330, and 1340 are typically welded or otherwise mechanically interconnected proximate a central location along upright frame members 1110, 1120, 1130, and 1140. Lower lateral members 1410, 1420, 1430, and 1440 are typically welded or otherwise mechanically interconnected proximate the upper end of upright frame members 1110, 1120, 1130, and 1140. Frame members 1110, 1120, 1130, 1140, 1210, 1220, 1230, 1240, 1310, 1320, 1330, 1340, 1410, 1420, 1430, and 1440 are typically constructed from structural steel tubing. Other suitable materials can likewise be used for the frame members.

Figure 3:
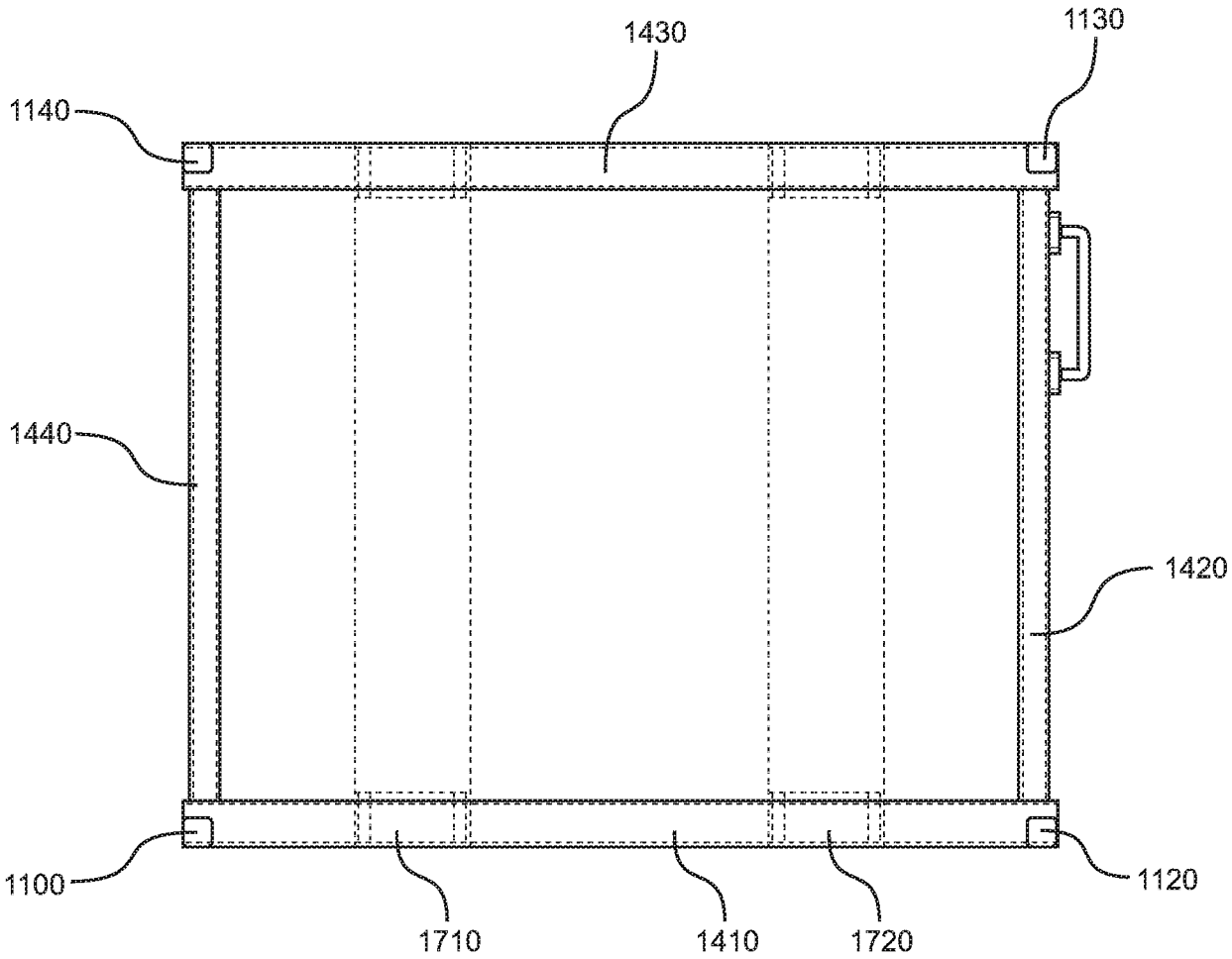
FIG. 3 is a bottom view of a transport system according to another aspect of this application.

Referring to FIGS. 1 and 3, in another aspect fork tubes 1710, 1720 are typically included with the base of the frame 1000 assembly to receive the forks of a fork truck to permit movement of the system by a fork truck. The fork tubes 1710, 1720 can be constructed from one quarter (¼) inch bent steel, but other materials, configures, and sizes can likewise be used. Other structures besides the fork tubes as shown can likewise be used to receive the forks of a fork truck at the base or other location of the system.

Removable Sidewalls

In another aspect, system 10 typically includes optionally removable sidewalls 2100, 2200, 2300, and 2400. The sidewalls 2100, 2200, 2300, and 2400 are typically constructed from a material that is sufficiently strong, durable, and resilient for use in connection with transporting granular materials such as sand or other proppant. In another aspect, sidewalls 2100, 2200, 2300, and 2400 are typically constructed from a material having a lower density or lower weight than the materials used for frame 1000. In one aspect, the sidewalls 2100, 2200, 2300, and 2400 can be constructed from 3/16 inch corrugated aluminum. Alternatively, any other thickness and material not inconsistent with the purpose of the present application can be used for the sidewall. Such sidewalls are optionally corrugated to enhance the durability and strength of such sidewalls. The angled sidewalls resulting from such corrugation typically distribute the force and load created by the materials being transported, thereby reducing the likelihood of sidewall failure when compared to a sidewall that is not corrugated or otherwise configured to distribute such load forces.

In another aspect, the sidewalls 2100, 2200, 2300, and 2400 are typically bolted to the system frame 1000. Referring to FIG. 1, a corrugated band of steel 1510 can be welded to the frame 1000 assembly to facilitate the fastening of the sidewall 2100 to the frame 1000. Additional steel bands (e.g., band 1520 shown in FIG. 2) can be included on the other sides of the frame 1000. The configuration of these bands (e.g., bands 1510, 1520) can match the configuration of the corrugated sidewalls, permitting the sidewalls 2100, 2200, 2300, and 2400 to be bolted to the band (e.g., bands 1510, 1520). When a sidewall 2100, 2200, 2300, or 2400 becomes damaged or replacement is otherwise desired, the existing sidewall can be unbolted from the band, and a replacement sidewall can be bolted onto the band. In addition to bolts, other fastening structures and methods can likewise be used to interconnect the sidewall with the steel frame assembly, including without limitation adhesives or rivets.

The ability to replace a sidewall 2100, 2200, 2300, or 2400 by unbolting the sidewall from the frame assembly can reduce the time and cost associated with such replacement when compared to repairs on a conventional system. In addition, the number of people needed to make such repair can be reduced. Typically, a single person will be able to unbolt, remove, and replace the sidewall, especially in view of the lighter weight material used for the sidewall. A repair to the sidewall of a conventional system typically requires at least two people, especially if the sidewall panel is constructed from steel.

Optionally Removable Top

Figure 5:
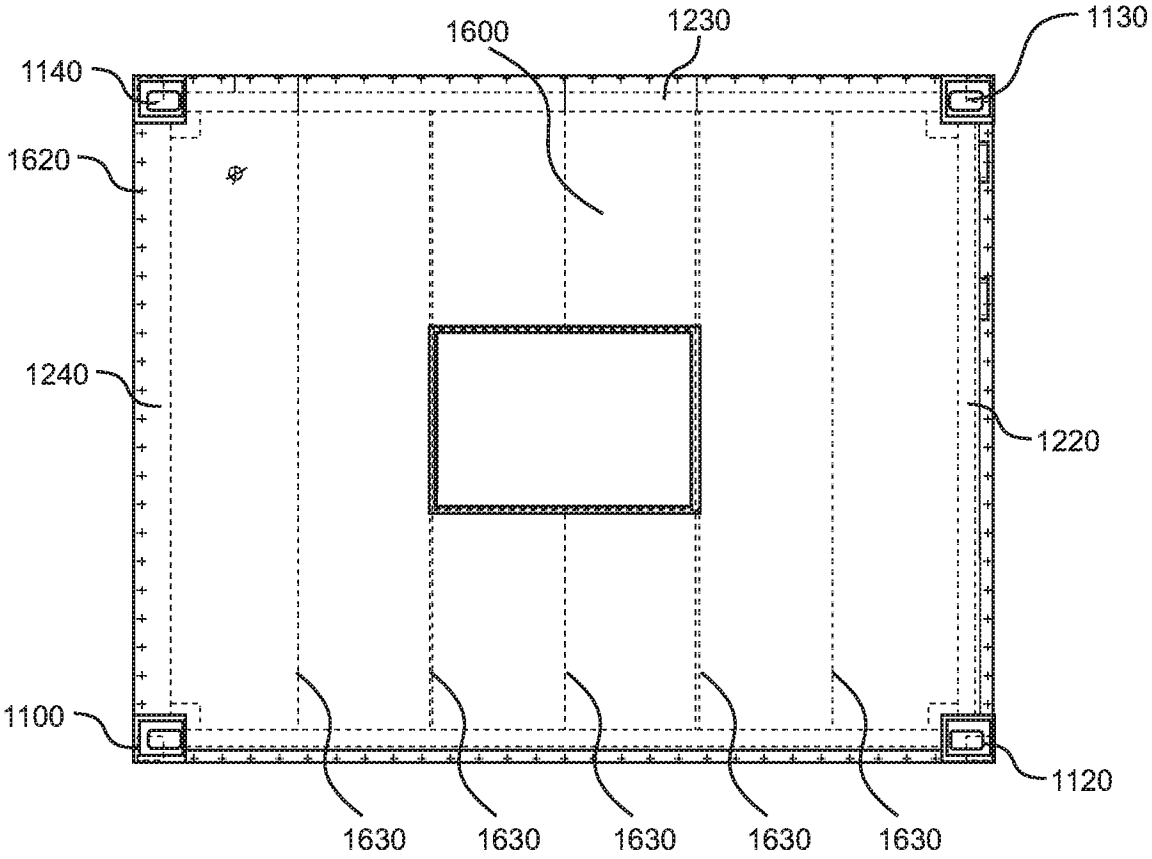
FIG. 5 is another top view of a transport system according to another aspect of this application.

Referring to FIGS. 1 and 5, in another aspect the system 10 can also include a top 1600 that can be removably attached to the frame assembly 1000. As with the sidewalls 2100, 2200, 2300, or 2400, the top 1600 can be constructed from a lighter weight material when compared to other components of the system such as the frame 1000 assembly. In one aspect, top 1600 can be constructed from aluminum. Top 1600 typically includes a hinged roof hatch cover assembly 1610 that can be optionally opened and closed. In another aspect, the top 1600 is bolted to a steel band 1630 that is interconnected with the frame 1000 assembly. The top 1600 can be replaced by unbolting the top 1600 from the frame 1000 assembly, and a replacement top 1600 can be bolted to the band 1630. In addition to bolts, other fastening structures and methods can likewise be used to interconnect the sidewall with the steel frame assembly, including without limitation adhesives or rivets. As with the removable sidewalls 2100, 2200, 2300, or 2400, the repair and replacement of the removable top portion of the system is less time consuming and expensive when compared with removing and repairing a conventional top that is typically welded to the frame assembly.

Hopper Assembly

Referring to FIGS. 1, 2, 4, 6, and 7 in another aspect a hopper 3000 assembly can be removably interconnected with the frame 1000 assembly. Hopper 3000 assembly can optionally be constructed from a material of lower weight or density than the materials used to construct the remainder of the system such as the frame 1000 assembly. The hopper 1000 assembly can be constructed from a material that is sufficiently strong, durable, and resilient for use in connection with transporting granular materials such as sand or other proppant. In one aspect, the hopper 3000 assembly can be constructed from aluminum. Alternatively, any material not inconsistent with the purpose of the present application can be used for the hopper 3000 assembly.

Figure 8:
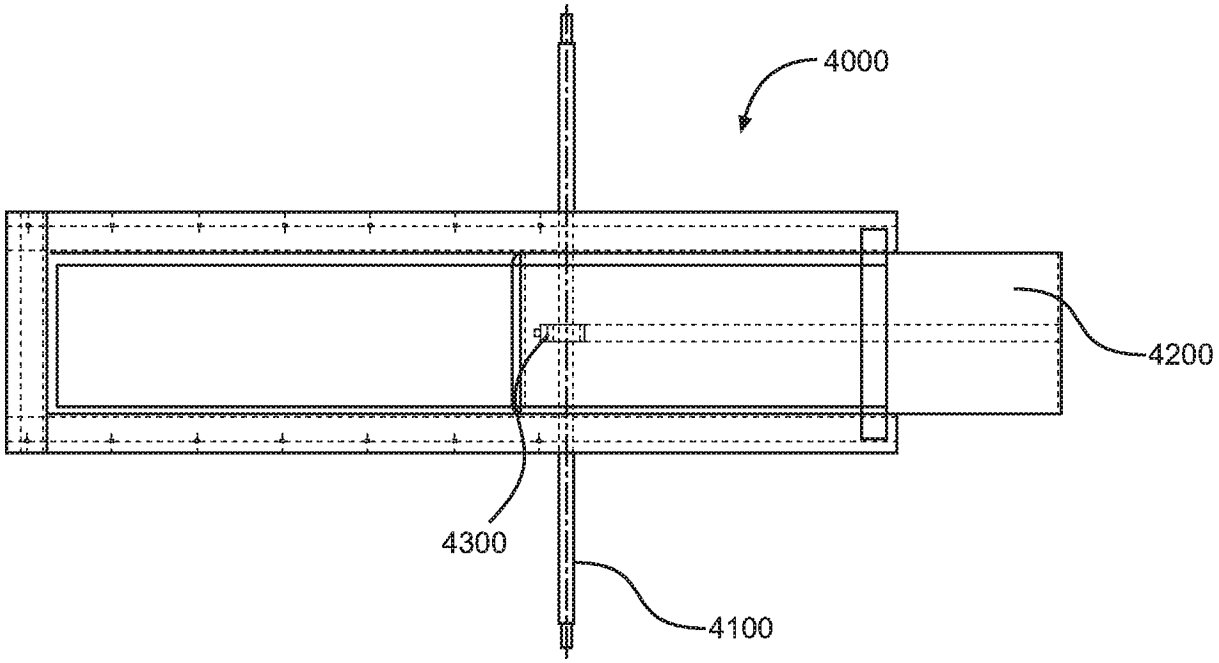
FIG. 8 is a top view of a slide gate assembly according to an aspect of this application.
Figure 9:
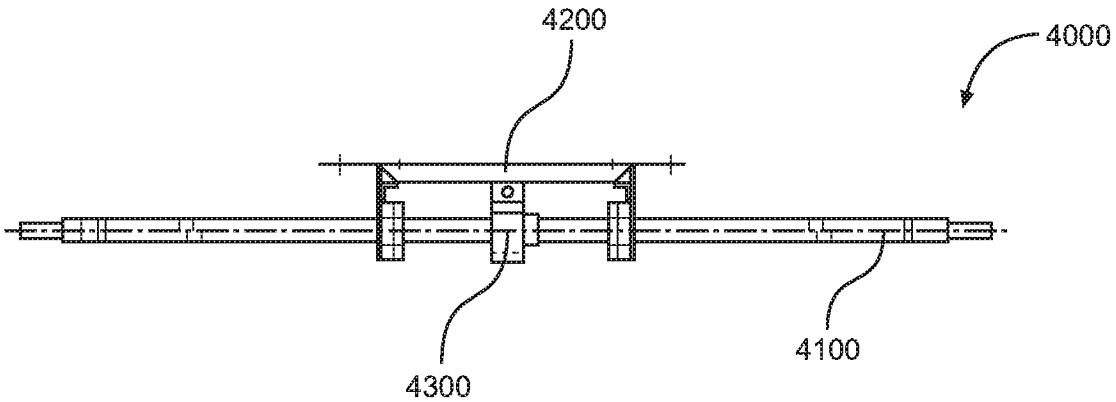
FIG. 9 is a side view of a slide gate assembly according to an aspect of this application.
Figure 10:
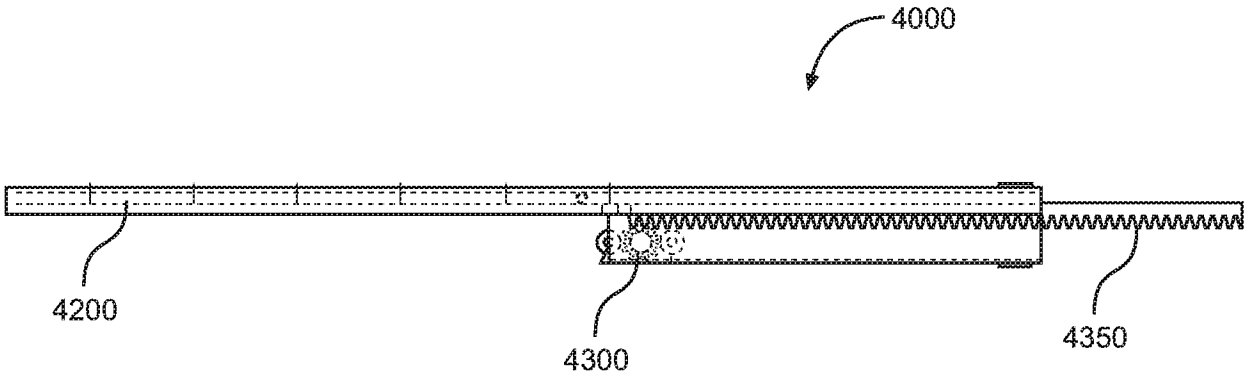
FIG. 10 is another side view of a slide gate assembly according to an aspect of this application.

In other aspects, the slope of the hopper sidewalls 3100 is typically thirty-six (36) degrees (see, e.g, FIG. 8). If the sidewall 3100 slope is not at least thirty-six (36) degrees, the contents of the container may not completely empty from the hopper assembly. In addition, the inner surface of the hopper 1000 assembly, as well as the inner surface of the entire container, should be free from ridges or other protrusions that could prevent the flow of the material being transported.

Figure 4:
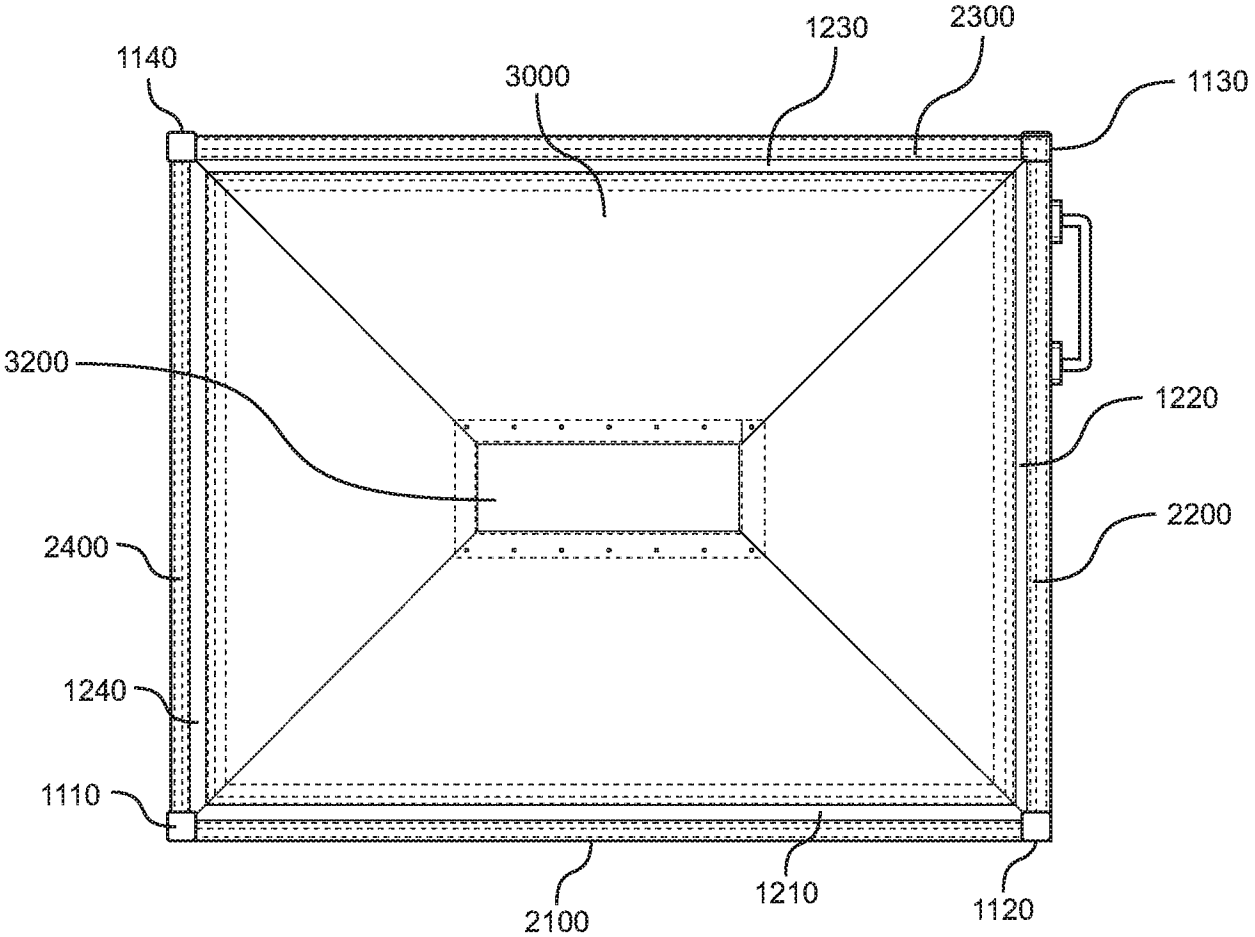
FIG. 4 is a top view of a transport system according to another aspect of this application.
Figure 6:
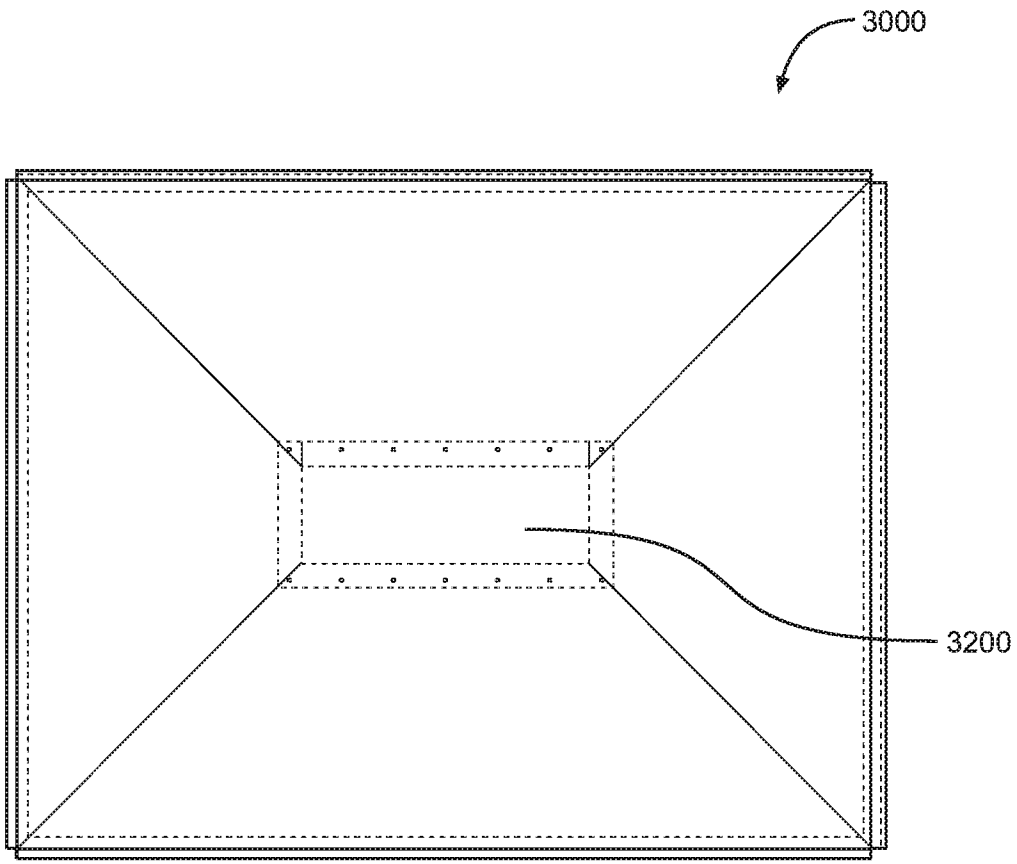
FIG. 6 is a top view of a hopper assembly according to an aspect of this application.
Figure 7:
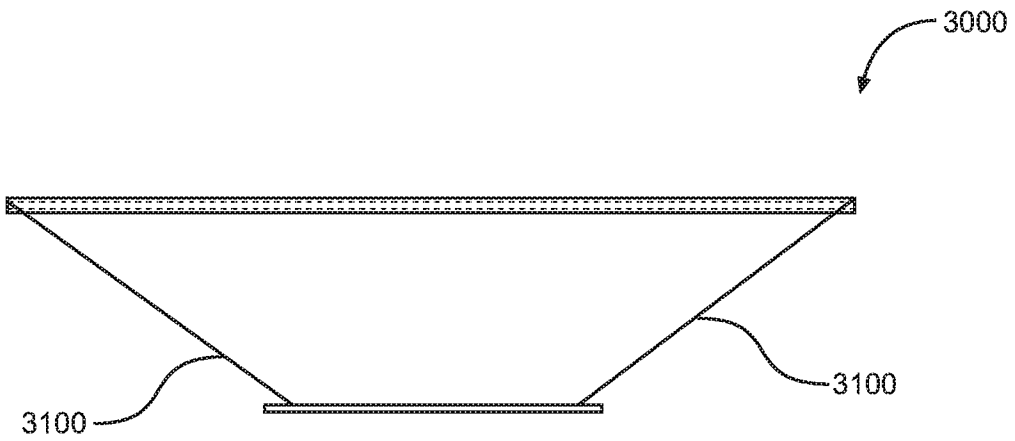
FIG. 7 is a side view of a hopper assembly according to an aspect of this application.

In other aspects, as illustrated in FIGS. 4 and 6, the greater width in the size of the discharge aperture 3200 at the base of the hopper 1000 allows for maintaining a thirty-six (36) degree slope on hopper side walls and increasing the vertical length of the system 10 sidewall. This increases the internal volume capacity of the system 10, while not exceeding the overall height dimension of nine feet six inches for the whole system 10, which is typically required for compliance with height restrictions when transporting the containers over the road on a truck.

Discharge Gate Assembly

Referring to FIGS. 1, 2, 8, 9, and 10, a discharge gate 4000 assembly is typically interconnected with the lower portion of the hopper 3000 assembly. The discharge gate 4000 assembly is typically opened to empty the contents from the container. In one aspect, a slide gate shaft 4100 is interfaced with sliding discharge flange 4200. The slide gate shaft 4100 is typically interconnected with a spur gear 4300 that interfaces with a gear rack 4350 mounted to the outer facing side of the sliding discharge flange 4200. When the slide gate shaft 4100 is rotated, the shaft 4100 causes rotation of the spur gear 4300, causing the sliding discharge flange 4200 to slide in a direction corresponding to rotation of the shaft 4100. Other mechanical or electro-mechanical structures can likewise be used to cause the movement of the discharge flange 4200. In addition, other structures besides a sliding discharge flange can be used to cause the contents of the container to discharge from the container.

In one aspect, each end of the slide gate shaft 4100 extends from the spur gear 4300 located proximate the sliding discharge flange 4200 and outward toward the frame 1000 assembly, typically interfacing with a slide gate shaft support bearing disposed on or otherwise interconnected with the frame assembly. In other aspect, each end of the slide gate shaft 4100 terminates at a distance inward from the outer edge of frame 1000 assembly, which can protect the shaft end from damage in the event the system contacts another object. A tee bar (not shown) can typically by interfaced with the end of the shaft 4100 to rotate the shaft 4100 and cause the sliding discharge flange 4200 to open or close as desired. In other aspects, another device could be interconnected over the end of the shaft to cause such rotation. For example, a tee bar or wheel could be interconnected with the rotating shaft to the inside of the bearing towards the spur gear. Such an integral tee bar, wheel, or other structure would eliminate the need for a separate tee bar or other structure that could become misplaced during transportation and cause reduced efficiency by causing a delay as the misplaced tee bar is located.

Modular Container Material Transport System Configuration

Referring to FIGS. 11, 12, 13, 14, 15, 16, 17, and 18, a material transport system 20 according to another aspect of the present application is shown. In one aspect, a container or vessel 6000 is removably disposed, or housed, in a frame 5000. In another aspect, the container 6000 is constructed from a material having properties that have different properties when compared with other materials typically used for frame 5000. By way of nonlimiting example, the container 6000 can be constructed from materials having one or more of lower density and lower weight when compared with the materials used for one or more aspects of the frame 5000. As one nonlimiting example, the container 6000 can be constructed from a composite material such as plastic. In other aspects, the container 6000 can be constructed from polypropylene composite or a fiber reinforced plastic ("FRP") composite. In other aspects, the frame is typically constructed from tubular steel. In one aspect, container 6000 can be constructed or molded as a unitary component. In other aspects, container 6000 can be constructed or molded from a plurality of components that are fastened together or otherwise assembled to form container 6000.

Referring to FIG. 11, the container 6000 is typically removably disposed in a frame 5000. The frame typically includes upright frame members 5110, 5120, 5130, and 5140, upper lateral frame members 5210, 5220, 5230, 5240, central lateral frame members 5310, 5320, 5330, 5340, and lower lateral frame members 5410, 5420, 5430, and 5440. In one aspect, such frame 5000 members are constructed from tubular steel. Other materials having properties suitable for supporting a container 6000 when filled with a material such as proppant can likewise be used for the frame members. The frame 5000 members can be interconnected with one another in a variety of ways including welding, bolts, and other similar interconnections.

In another aspect, the upper lateral frame members 5210, 5220, 5230, and 5240 are removably interconnected with each other and the upright frame members 5110, 5120, 5130, and 5140 using coupling members 5010, 5020, 5030, and 5040 to permit the removal of the container 6000 as desired. In one aspect, the upper lateral frame members 5210, 5220, 5230, and 5240 are bolted together and oriented as shown in FIGS. 11, 12, 13, and 14. In another aspect and with reference to FIGS. 11, 12, 13, and 14, the coupling members 5010, 5020, 5030, and 5040 positioned at the top of the frame 5000 assembly can typically include an aperture 5012 (e.g., ISO corner casting). In another aspect, the footprint of this transport system 20 can be 8 feet by 13 feet, along with a typical capacity of 52,000 pounds. Other suitable dimensions can likewise be used.

Referring to FIGS. 11, 12, 15, 16, 17, and 18 the container 6000 typically includes a connection structure 6010, 6020, 6030, and 6040 that permits the container 6000 to be secured to the frame 5000. In one aspect, the connection structures can be flanges 6010, 6020, 6030, and 6040. In another aspect, the flanges can extend beyond the container sidewalls 6100, 6200 in a direction generally perpendicular to the surface of sidewalls 6100, 6200 as shown in 11, 12, 15, 16, 17, and 18. In another aspect, the flanges can extend beyond the container endwalls 6300, 6400 in a direction generally perpendicular to the surface of endwalls 6300, 6400 (not shown). As another nonlimiting example, the flanges can be positioned for connection with lateral frame members rather than the upright frame members (not shown).

The container 6000 can be optionally connected to the frame 5000 using bolts that extend through apertures in the flanges and upright frame members. Other connection structures such as pins can likewise be used to connect the flange with the frame. In other aspects, other connection structures can be used to connect the container with the frame In another aspect, the flanges 6010, 6020, 6030, and 6040 can be optionally integral with the container 6000 and cast in place during the container molding process. In other aspects, the flanges 6010, 6020, 6030, and 6040 can be a separate component from the container 6000 and mechanically fastened to the container 6000.

Figure 12:
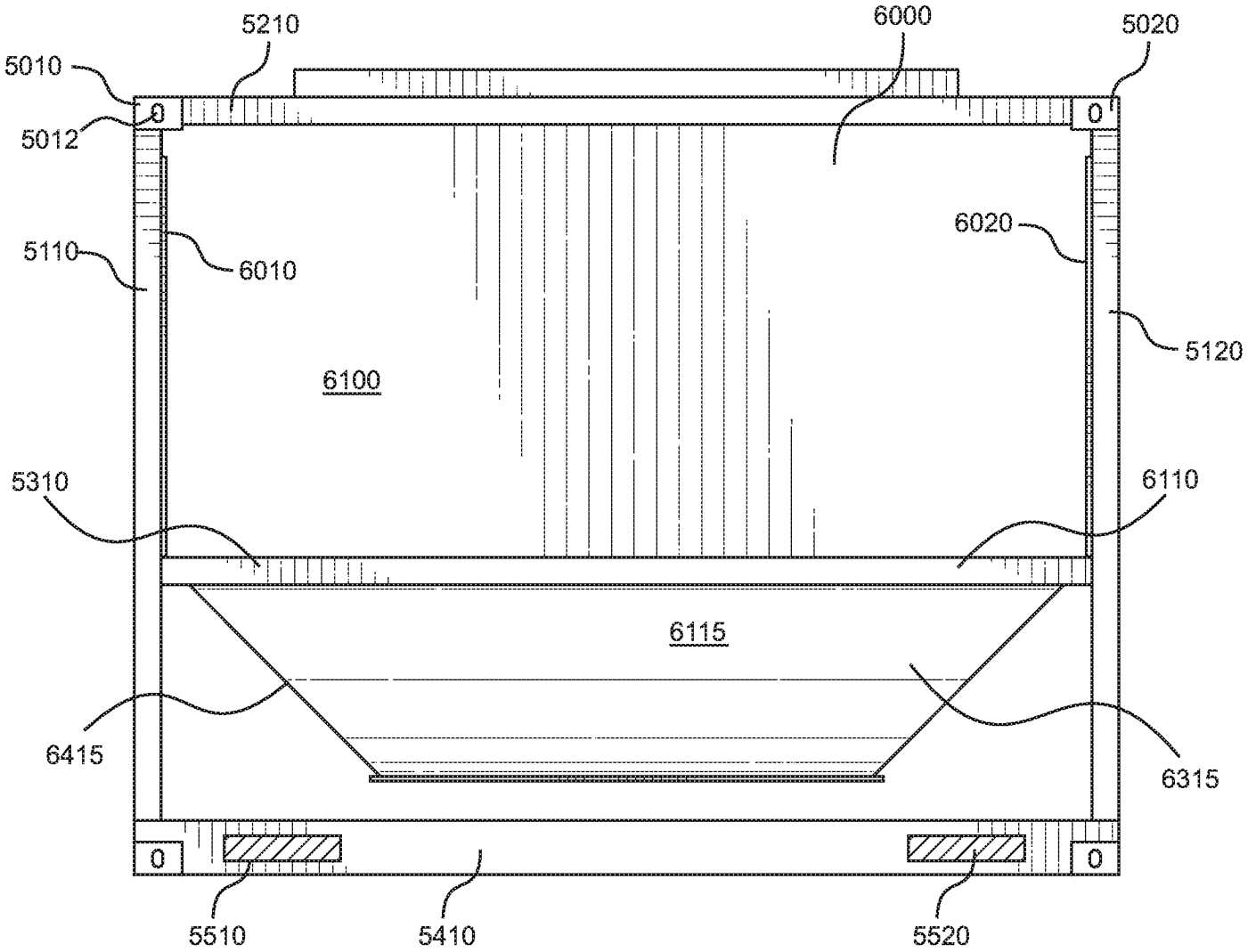
FIG. 12 is a front view of another transport system according to another aspect of this application.
Figure 13:
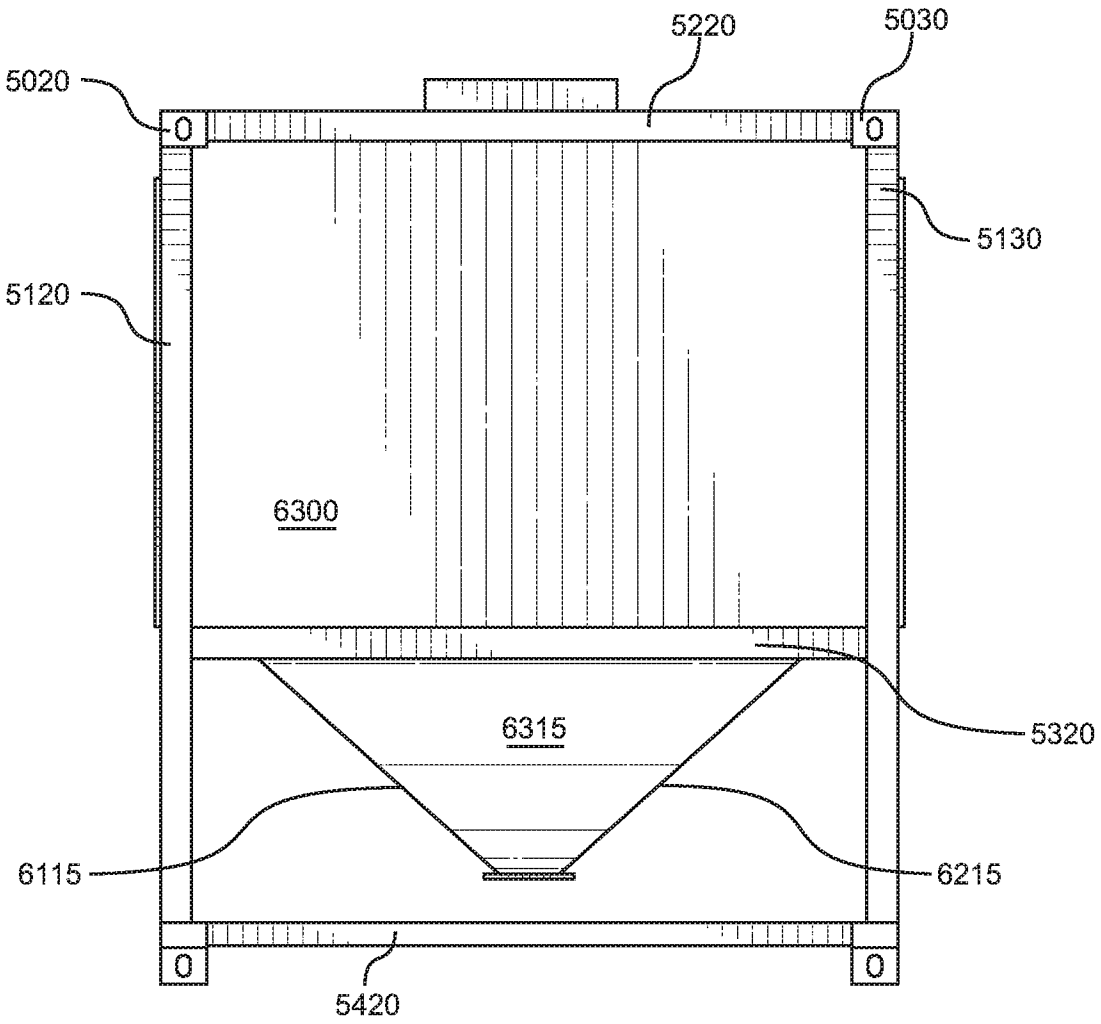
FIG. 13 is a side view of another transport system according to another aspect of this application.
Figure 14:
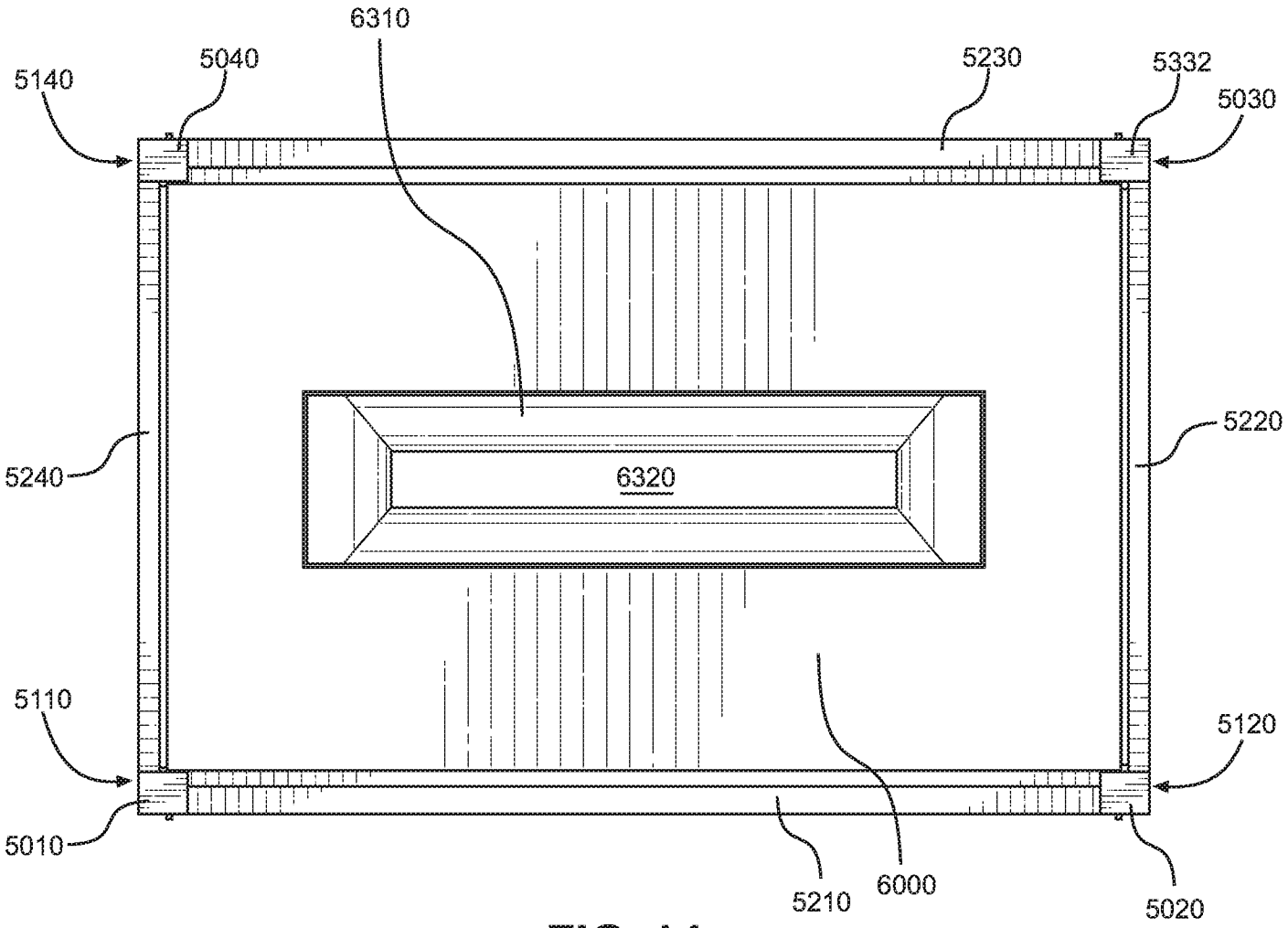
FIG. 14 is a top view of another transport system according to another aspect of this application.
Figure 15:
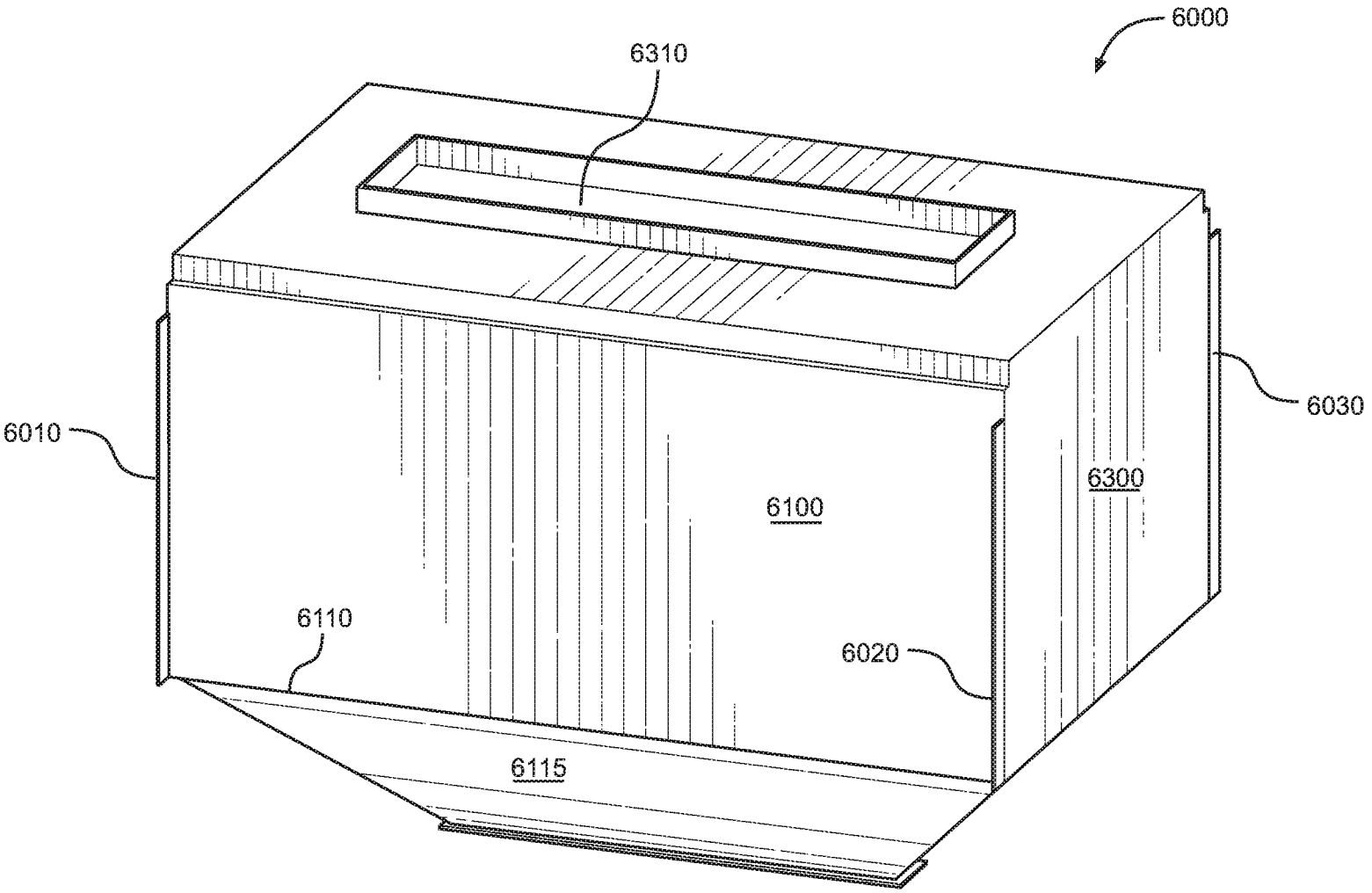
FIG. 15 is a perspective view of a container according to another aspect of this application.
Figure 16:
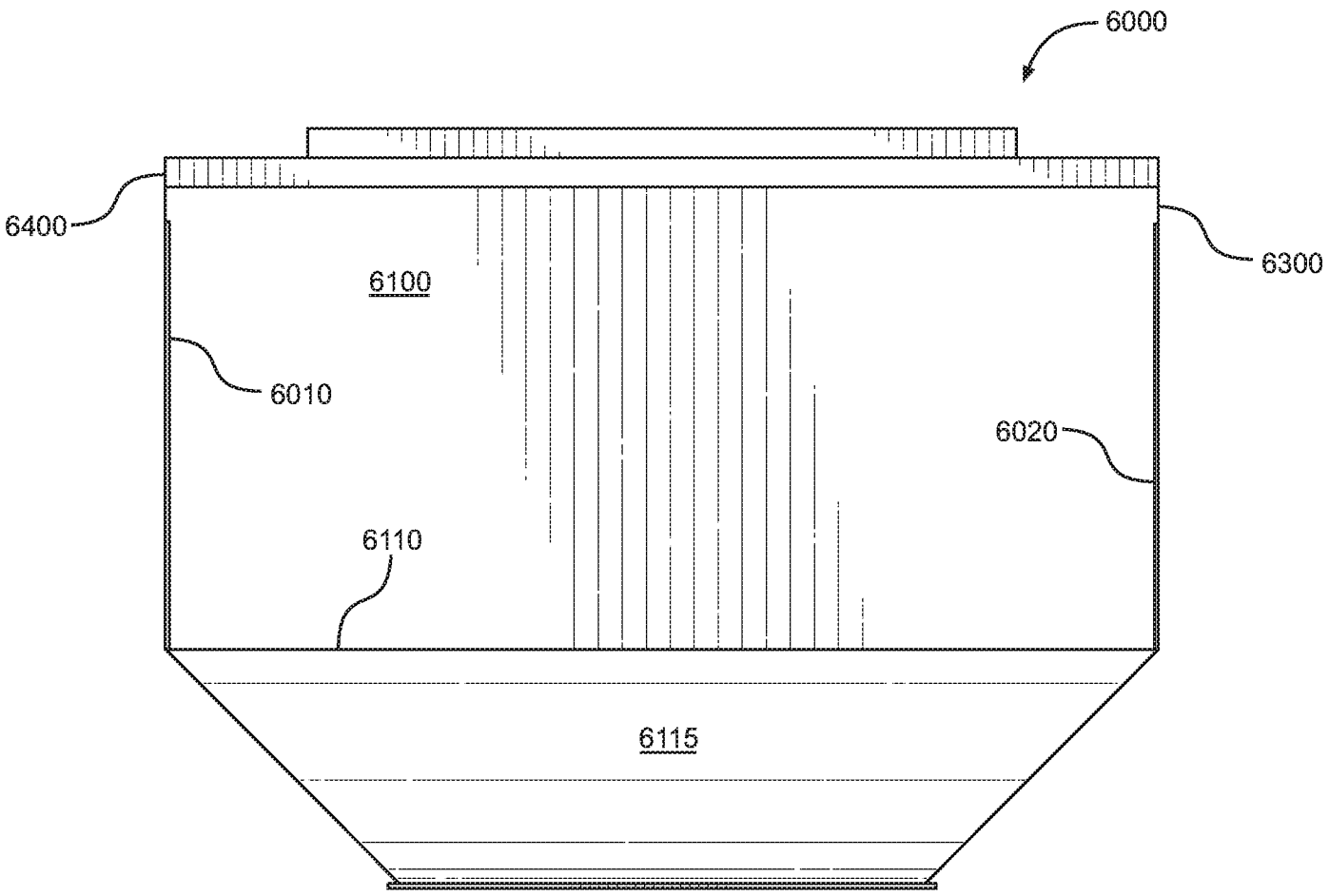
FIG. 16 is a front view of a container according to another aspect of this application.
Figure 17:
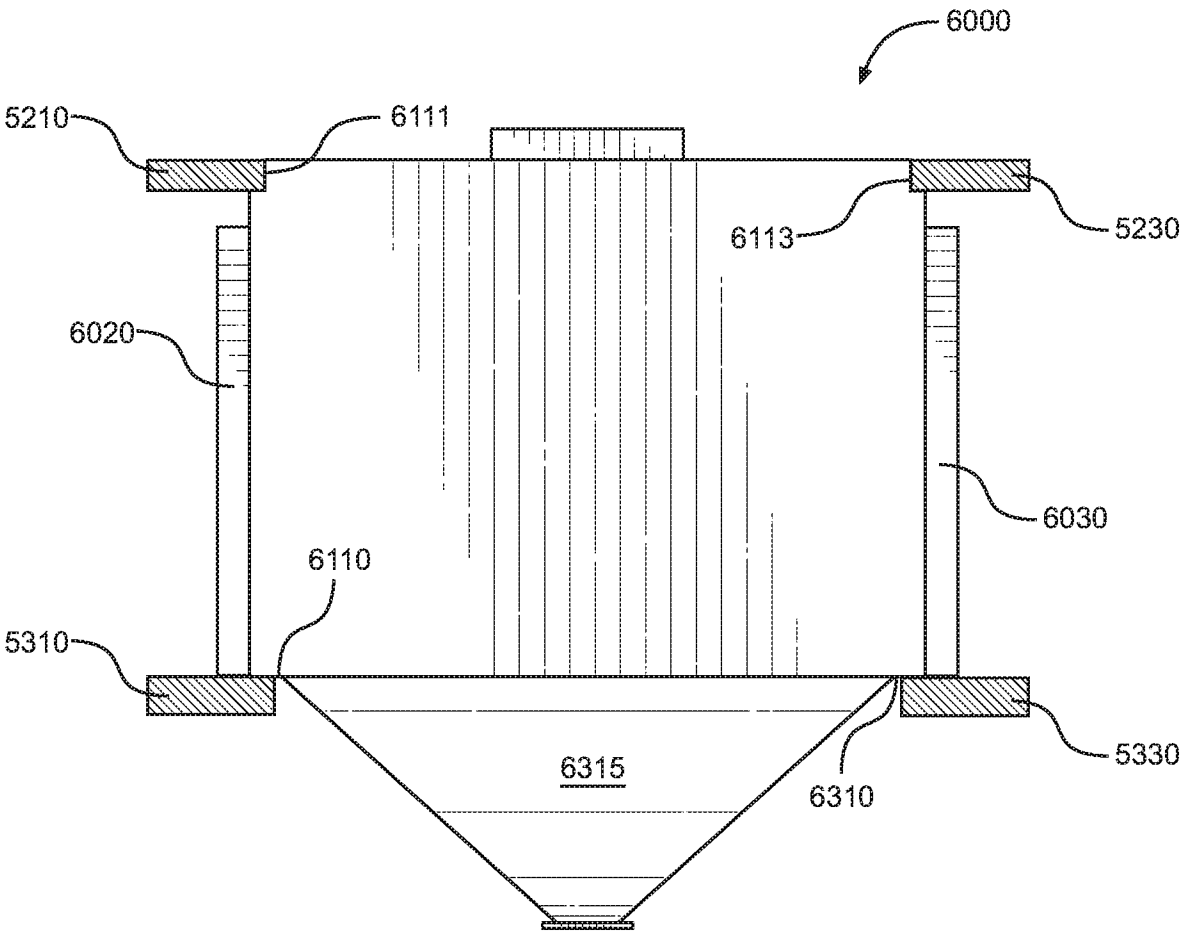
FIG. 17 is a side view of a container according to another aspect of this application.
Figure 18:
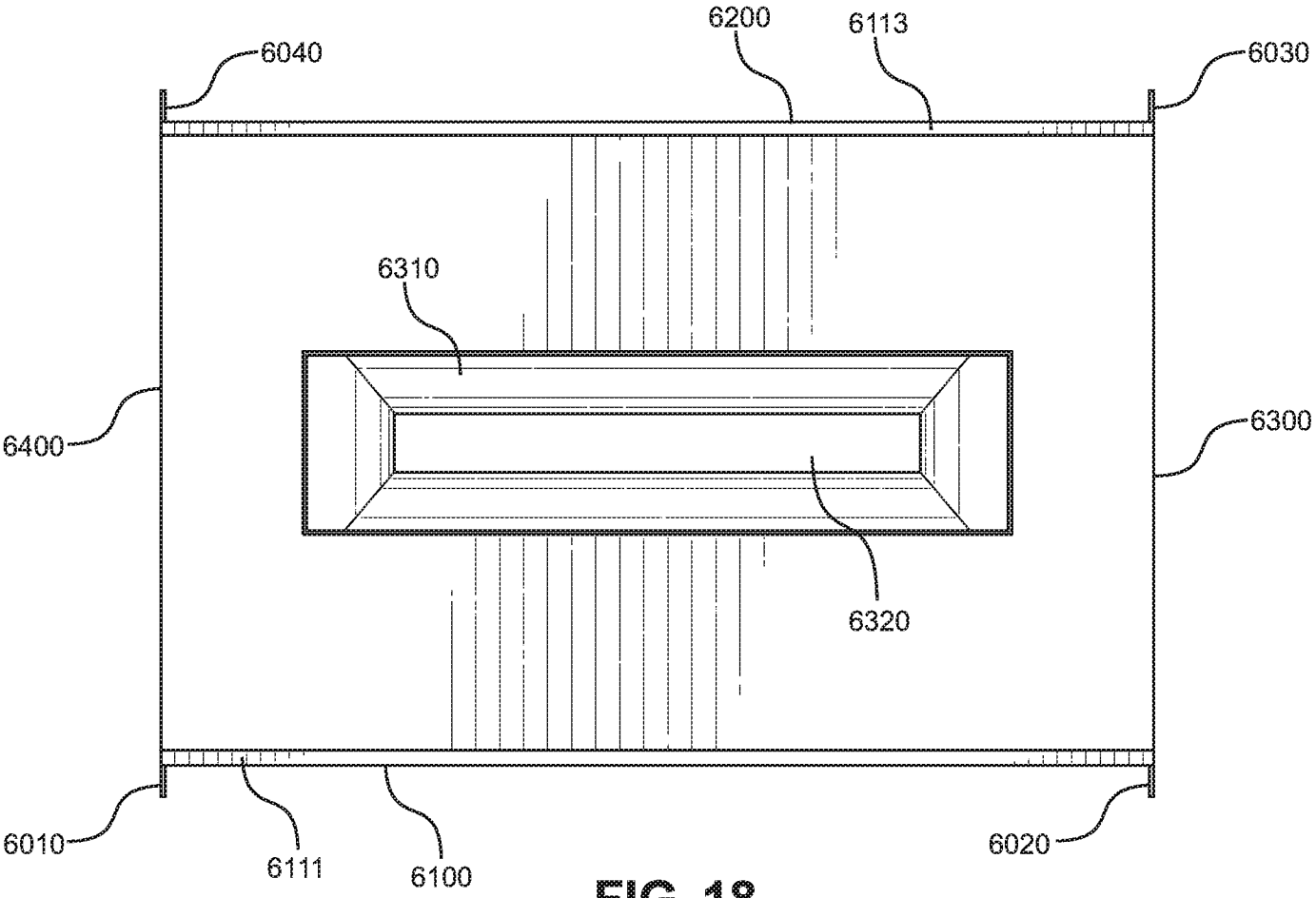
FIG. 18 is a top view of a container according to another aspect of this application.

Referring to FIGS. 11, 12, and 17, in other aspects a portion of the container surfaces 6110 and 6320 can be set on a portion of the top surfaces of lateral frame members 5310 and 5330. Referring to FIG. 18 by way of nonlimiting example, the container 6000 is shown with a portion of the container surface 6110, 6310 set on a portion of the upper surface of a lateral frame member 5310, 5330. In another aspect, a portion of the lower surface of a flange 6010, 6020, 6030, 6040 can also rest on the upper surface of a lateral frame member 5310, 5330. In other aspects, the lower surface of a flange will not rest upon the upper surface of a lateral frame member because a space can be present between the lower flange surface and lateral frame member upper surface. Also as shown in FIG. 17, in another aspect, the outer edge of the flange 6010, 6020, 6030, 6040 optionally may not extend beyond the outer side surface of one or more of the lateral frame members 5310, 5330 or one or more of the other frame members 5110, 5120, 5130, 5140, 5210, 5220, 5230, and 5240. In this nonlimiting, exemplary geometry, the lateral and upright frame members protect the flanges 6010, 6020, 6030, 6040 from becoming damaged from a variety of causes including accidental contact of the container system with another object. In other aspects, the outer edge of one or more of the flanges can extend to be generally conterminous with the outer surfaces of the lateral and upright frame members. In other aspects, the outer edge of one or more of the flanges can extend beyond outer surfaces of the lateral and upright frame members.

Referring to FIGS. 17 and 18, the top portion of the container 6000 can optionally include a recess 6111, 6113 to accommodate an interlocking arrangement with the upper lateral frame members 5210 and 5230. Such an arrangement can prevent horizontal movement of the container within the frame. In other aspects, the recess could be positioned in the upper surface of the short sides of the container rather than the in upper surface of the long sides of the container. In other aspects, other structures could be incorporated into the frame or container design to prevent horizontal container movement in relation to the frame.

Referring to FIGS. 11, 12, 13, 15, 16, and 17, the lower sidewalls 6115, 6215, 6315, and 6415 of the container 6000 are sloped inward. In another aspect, the slope of the container sidewalls 6115, 6215, 6315, and 6415 is typically thirty-six (36) degrees. If the sidewall slope is not at least thirty-six (36) degrees, the contents of the container may not completely empty from the container. In addition, the inner surface of the container 6000 should be free from ridges or other protrusions that could prevent the flow of the material being transported in the container.

Referring to FIGS. 11, 14, 15, and 18, the container 6000 also includes an aperture 6310 in the top surface of the container 6000 and another aperture 6320 in the bottom surface of the container 6000. Both the top and bottom aperture 6310, 6320 include a cover that can be optionally opened and closed. As one nonlimiting example, when filling the container 6000 with a material such as proppant, the cover (not shown) on the top surface of the container will be oriented to expose the aperture 6310 on the top surface, and the cover (not shown) on the bottom surface will be oriented to cover the aperture 6320 on the lower surface to prevent the material from discharging through the bottom aperture.

In other aspects, the lower lateral frame members can also include fork tubes 5510, 5520 to receive the forks of a fork truck.

Following is a nonlimiting example of replacing a damaged container 6000 according to another aspect of the application. In the event that the container 6000 becomes damaged, the damaged container 6000 can be removed from the frame 5000 and replaced by a new, undamaged container. The bolts connecting the container flanges 6010, 6020, 6030, 6040 to the frame uprights 5110, 5120, 5130, 5140, are removed. The bolts connecting the top lateral frame members 5210, 5220, 5230, and 5240 to the coupling structures 5010, 5020, 5030, and 5040 atop each of the upright frame members 5110, 5120, 5130, and 5140 are removed. The top lateral frame members 5210, 5220, 5230, and 5240 are removed from the assembly, and the coupling structures 5010, 5020, 5030, and 5040 are also removed from the top of each upright frame member 5110, 5120, 5130, and 5140. The damaged container 6000 is then lifted from the frame 5000 assembly using hooks (not shown) that are connected with rings (not shown) mounted in the container 6000 top. A new, undamaged container is then lowered into the frame assembly. Bolts are inserted through each aperture in the upright frame members 5110, 5120, 5130, 5140 and the corresponding apertures in each flange 6010, 6020, 6030, 6040. The coupling structures 5010, 5020, 5030, and 5040 are replaced on the top of each upright frame member 5110, 5120, 5130, and 5140, and the top lateral frame members 5210, 5220, 5230, and 5240 are then reconnected with the coupling structures 5212, 5222, 5232, 5242. Once the foregoing components are properly seated, all of the bolts are tightened to a desired torque. The foregoing example is nonlimiting, as a variety of other suitable techniques could also be used to replace a damaged container. Additionally, the location of flanges or other support members on the container, as well as the geometry of the container 6000 in relation to the frame 6000 will affect the steps and procedures for replacing a container 6000 or other components of system 20.

The system of the present application can be used in a variety of applications. In addition to usage at a transloading facility as described above, the present system can be incorporated right into the oil drilling pad at a drilling location. Instead of sending a large number of pneumatic trucks to a transload facility when sand is needed, usage of the system described herein could permit all the sand needed to be staged on site or close by. Such nearby storage could solve the typical concern over possibly losing continual flow of sand into the well during operations. In addition, the system described herein could be used in the grain and coal industries, as well as other bulk dry goods that are typically shipped today using conventional methods.

This written description uses examples to disclose the invention, including the best mode, and also to enable any person skilled in the art to make anew the invention. Any dimensions or other size descriptions are provided for purposes of illustration and are not intended to limit the scope of the claimed invention. Additional aspects can include slight variations, as well as greater variations in dimensions as required for use in the industry. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container system, comprising:

a plurality of upright frame members, each having a first end and a second end;

a plurality of upper lateral frame members, each disposed between the upright frame members proximate the first end of the upright frame members;

a plurality of lower lateral frame members, each disposed between the upright frame members proximate the second end of the upright frame members;

a plurality of central lateral frame members, each disposed between the upright frame members proximate a predetermined distance between the first end and the second end of the upright frame members, each extending from one of the plurality of upright frame members to another of the plurality of upright frame members; and a modular container disposed at least partially within the space created by the upright frame members, the upper lateral frame members, the central lateral frame members, and the lower lateral frame members, wherein the modular container is removably affixed to one or more of the upright frame members, upper lateral frame members, and central lateral frame members, wherein the modular container has a geometry such that a surface of the container is supported by one or more of the central lateral frame members, wherein the modular container has a sliding discharge gate interconnected with a bottom portion of the hopper assembly, and wherein the modular container is constructed from a material having properties different from the properties of one or more of the upright frame members, the upper lateral frame members, and central lateral frame members.

2. The system of claim 1, wherein the container is constructed from a material having a density that is lower than a density of one or more of the upright frame members, the upper lateral frame members, and central lateral frame members.

3. The system of claim 1, wherein the container is constructed from a composite material.

4. The system of claim 1, further comprising a plurality of connection structures extending beyond the surface of the container.

5. The system of claim 4, wherein each of the plurality of connection structures is a flange.

6. The system of claim 4, wherein one or more of the connection structures are integral with the container.

7. The system of claim 4, wherein one or more of the of the connection structures is removably affixed to one or more of the upright frame members.

8. The system of claim 4, wherein one or more of the connection structures is removably affixed to one or more of the upper lateral frame members.

9. The system of claim 4, wherein one or more of the connection structures is removably affixed to one or more of the central lateral frame members.

10. The system of claim 4, wherein one or more of the connection structures extend beyond an outer surface of the upright frame members.

11. The system of claim 4, wherein one or more the connection structures extend beyond an outer surface of one or more of the upper lateral frame members.

12. The system of claim 4, wherein one or more the connection structures extend beyond an outer surface of one or more of the central lateral frame members.

13. The system of claim 4, wherein one or more of the connection structures at least partially contacts one or more of upright frame members.

14. The system of claim 1, wherein a surface of the container is supported by one or more of the plurality of central lateral frame members.

15. The system of claim 1, wherein the container includes at least one recess that is configured receive at least a portion of one or more of the upper lateral frame members.

16. The system of claim 15, wherein at least one recess is configured to be in at least partial contact with at least a portion of one or more of the upper lateral frame members.

17. The system of claim 1, wherein the container is unitary component.

18. The system of claim 1, wherein the container is a plurality of components.

19. A container system, comprising:

a plurality of upright frame members, each having a first end and a second end;

a plurality of upper lateral frame members, each disposed between the upright frame members proximate the first end of the upright frame members;

a plurality of lower lateral frame members, each disposed between the upright frame members proximate the second end of the upright frame members;

a plurality of central lateral frame members, each disposed between the upright frame members proximate a predetermined distance between the first end and the second end of the upright frame members, each extending from one of the plurality of upright frame members to another of the plurality of upright frame members; and a modular container disposed at least partially within the space created by the upright frame members, the upper lateral frame members, the central lateral frame members, and the lower lateral frame members, wherein the modular container includes a plurality of flanges extending from a surface of a first endwall and a surface of a second endwall, wherein the flanges are removably affixed to one or more of the upright frame members, wherein the modular container has a geometry such that a surface of the container is supported by one or more of the central lateral frame members, wherein the modular container has a sliding discharge gate interconnected with a bottom portion of the hopper assembly, and wherein the modular container is constructed from a composite material having properties different from the properties of one or more of the upright frame members, the upper lateral frame members, and central lateral frame members.

20. A container system, comprising:

a plurality of upright frame members, each having a first end and a second end;

a plurality of upper lateral frame members, each disposed between the upright frame members proximate the first end of the upright frame members;

a plurality of lower lateral frame members, each disposed between the upright frame members proximate the second end of the upright frame members;

a plurality of central lateral frame members, each disposed between the upright frame members proximate a predetermined distance between the first end and the second end of the upright frame members, each extending from one of the plurality of upright frame members to another of the plurality of upright frame members;

a pair of sidewall panels, each removably fastened to one or more of the upright frame members, the upper lateral frame members, and central lateral frame members;

a pair of endwall panels, each removably fastened to one or more of the upright frame members, the upper lateral frame members, and central lateral frame members; and a hopper assembly removably fastened to lower surfaces of the central lateral frame members, wherein the sidewall panels have a corrugated geometry to increase the load capacity of the panels, wherein the sidewall panels are constructed from a material have a lower density than the density of one or more of the upright frame members, the upper lateral frame members, and central lateral frame members, wherein the endwall panels have a corrugated geometry to increase the load capacity of the panels, wherein the endwall panels are constructed from a material have a lower density than the density of one or more of the upright frame members, the upper lateral frame members, and central lateral frame members, and wherein the hopper assembly is constructed from a material have a lower density than the density of one or more of the upright frame members, the upper lateral frame members, and central lateral frame members, wherein the hopper assembly has a sliding discharge gate interconnected with a bottom portion of the hopper assembly.

21. The system of claim 20, wherein one or more of the upright frame members, upper lateral frame members, central lateral frame members, and lower lateral frame members are constructed from tubular steel.

22. The system of claim 20, wherein one or more of the sidewall panels are constructed from aluminum.

23. The system of claim 20, wherein one or more of the endwall panels are constructed from aluminum.

* * * * *